United States Patent [19]

Suzuki et al.

[11] 4,197,623

[45] Apr. 15, 1980

[54] FACTORY BARGE FOR MANUFACTURING REINFORCED ELONGATED CONCRETE PRODUCTS

[75] Inventors: Toshimasa Suzuki; Chiaki Matsuyama, both of Hiroshima; Susumu Ogawa, Fukuyama; Yoshitaka Itoh, Ebina; Yasuo Usui, Chigasaki, all of Japan

[73] Assignees: Mitsubishi Jukogyo Kabushiki Kaisha; Daido Concrete Co., Ltd.; Shimizu Harbor Const. Corp., all of Japan

[21] Appl. No.: 893,341

[22] Filed: Apr. 4, 1978

[30] Foreign Application Priority Data

Jul. 19, 1977 [JP] Japan ..... 52-86293

[51] Int. Cl.[2] ..... B28B 15/00; B28B 23/02

[52] U.S. Cl. ..... 29/33 D; 114/270; 425/62; 425/88

[58] Field of Search ..... 425/61, 62, 88; 29/33 F, 33 D; 140/112; 114/270

[56] References Cited

U.S. PATENT DOCUMENTS

| | | | |
|---|---|---|---|
| 379,923 | 3/1888 | Anderson | 425/62 |
| 390,545 | 10/1888 | Aikman | 425/61 X |
| 451,463 | 4/1891 | Dickson | 425/62 X |
| 2,630,091 | 3/1953 | Bonnington et al. | 114/270 X |
| 3,262,411 | 7/1966 | Kaltenecker | 114/270 X |

*Primary Examiner*—Jan H. Silbaugh

*Attorney, Agent, or Firm*—McGlew and Tuttle

[57] ABSTRACT

A factory barge for manufacturing reinforced concrete products comprises a batcher plant mounted at one end of the hull for preparing ready mixed concrete, a reinforced concrete product unloader mounted at the opposite end of the hull, and, between the batcher plant and the unloader, in the order mentioned, concrete placers for receiving the concrete from the batcher plant and placing it into elongated molds held in the fore-and-aft direction, compactors for compacting the concrete in the molds, a curer for curing the concrete compacted in the molds, and a mold remover for removing the molds from the cured concrete products. An equipment for fabricating reinforcement cylinders is mounted on a deck above the deck where the concrete placers are installed, and means for transferring the molds from the concrete placers to the compactors, curer, and mold remover is so disposed as to handle the molds while maintaining them in the fore-and-aft direction. The unloader includes a U-shaped opening formed at the end of the hull to accommodate a product delivery barge, and means for transferring the elongated reinforced concrete products, taken out of the molds by the mold remover, onto the delivery barge in the U-shaped opening, while maintaining the same orientation.

7 Claims, 9 Drawing Figures

FACTORY BARGE FOR MANUFACTURING REINFORCED ELONGATED CONCRETE PRODUCTS

This invention relates to a barge on which reinforced concrete goods, such as Hume pipes and concrete piles, are manufactured.

It has been customary that, when given reinforced concrete products are in demand at a place distant, for example across the sea, from a cement- and reinforcement-producing district, either precast products are sent by sea to the site where they are desired, or a factory is temporarily built at or near that site to meet the local demand. However, the marine transportation of the precast goods requires much freight and can cause damage when the destination is very far from the place of origin. The temporary construction of a factory at the place of consumption is not economically justified unless the demand is sufficiently large. The construction work in a remote area can take more time than expected and cause a delay in the delivery of the products. In addition, an unduly large proportion of the equipment can be damaged, worn out, or otherwise lost during the course of dismantling after the local demand has been satisfied.

Another possible method is to manufacture the reinforced concrete products off the coast of the consuming district, by a so-called floating plant. Such a plant, if built to be a reproduction in layout of a land plant of the same scale, would require a formidably large plane area; the vessel would have too large a breadth for towing or handling otherwise.

It is a fundamental object of this invention to solve the problems that arise from the effort on the part of the reinforced concrete manufacturer in an industrial district to meet the demand for the goods in a far-off point across the sea.

Another object of the invention is to provide a factory barge for manufacturing reinforced concrete products, aboard which the layout of the units for production is well planned, especially with a partial two-level structure, so that the production will generally proceed efficiently on board the vessel, which is reduced in breadth as well as in plane surface area.

These objectives of the invention are attained by providing a factory barge for manufacturing reinforced concrete products comprising a batcher plant mounted at one end of the hull for preparing ready mixed concrete, a reinforced concrete product unloader mounted at the opposite end of the hull, and, between the batcher plant and the unloader, in the order mentioned, concrete placers for placing the concrete received from the batcher plant into molds, compactors for compacting the concrete in the molds, a curer for curing the compacted concrete in the molds, and a mold remover for removing the molds from the cured concrete products, with a reinforcement cylinder-fabricating unit mounted on a deck above the deck where the concrete placers are installed so as to introduce reinforcement cylinders into the molds.

Also, the factory barge according to the invention is characterized in that the molds are elongated and disposed in the fore-and-aft direction and that the means for transferring the molds from the concrete placers to the compactors, curer, and mold remover is so disposed as to handle the molds while maintaining them in the same direction.

The factory barge according to the invention is further characterized in that the reinforced concrete product unloader comprises a U-shaped opening formed at the end of the hull to accommodate a product delivery barge, and means for transferring the elongated reinforced concrete products, taken out of the molds by the mold remover, onto the delivery barge in the U-shaped opening, while maintaining them in the same orientation.

The above and other objects, features, and advantages of the invention will become more apparent from the following description taken in conjunction with the accompanying drawings, in which.

Figure 1:
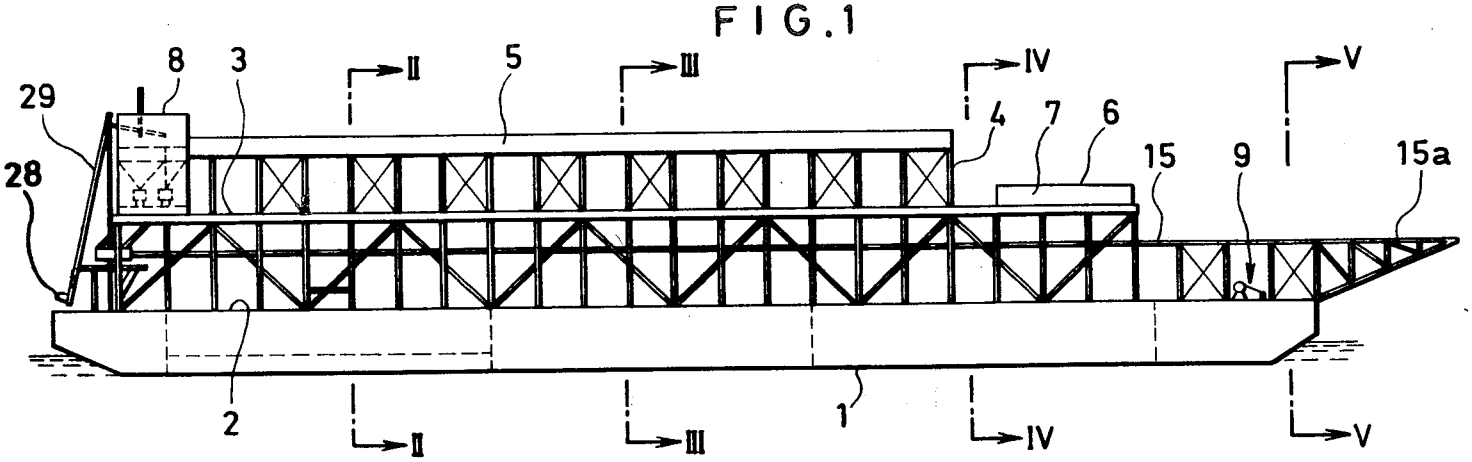
FIG. 1 is a schematic side elevational view of a factory barge equipped to manufacture reinforced concrete goods in accordance with the invention.

As shown in FIGS. 1 through 8, a barge embodying the invention comprises a hull 1 in the form of a flat-bottomed, rectangular structure having, above its upper deck 2, an intermediate deck 3, which in turn supports with stanchions 4 an uppermost shade deck or roof 5.

A short distance forward from the hull section with the roof 5, there is another weather deck 6 above the intermediate deck 3, with an accommodation 7 provided in between.

Figure 8:
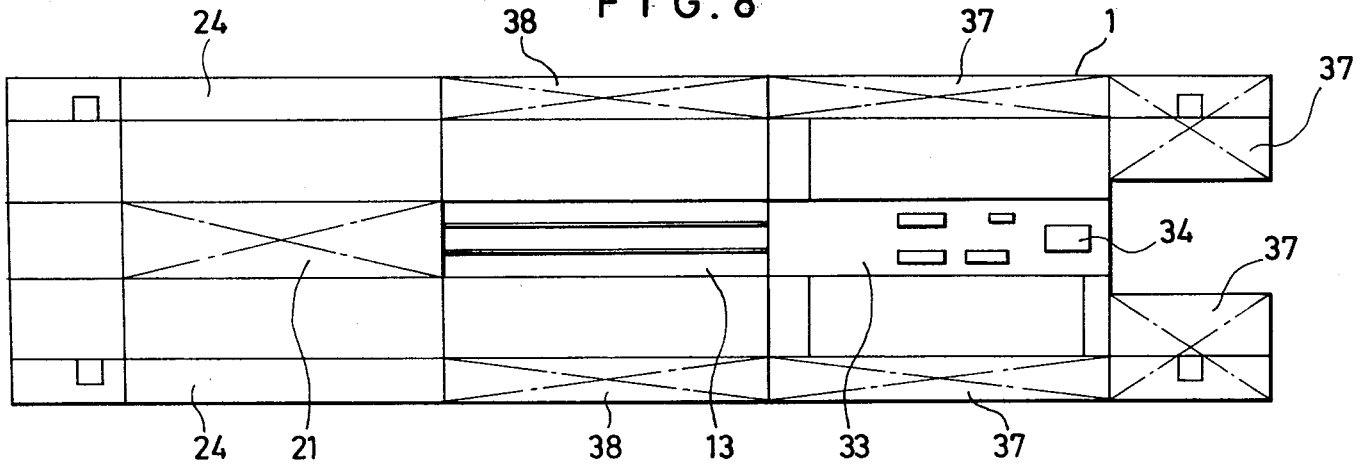
FIG. 8 is a horizontal sectional view of the hull showing the locations of tanks and holds.

At the stern is mounted a batcher plant 8 for preparing ready mixed concrete, and an unloader 9 for delivering reinforced concrete products is installed at the bow. Between the batcher plant 8 and the reinforced concrete product unloader 9, there are installed from stem to bow, concrete placers 11 which receive ready mixed concrete from the batcher plant 8 and place it into molds 10 (FIG. 9), centrifugal concrete compactors 12 for working the concrete into the molds 10 by centrifugal force, concrete curing tanks 13 for curing the concrete in the molds with steam, and a mold remover 14 for disassembling and detaching the molds from the cured concrete pipes. Of these component units, those on the upper deck 2, e.g., the units 11, 12 and rails 30*a* to be described later, are arranged in two rows symmetrically with respect to the centerline of the hull, as shown particularly in FIG. 7. The concrete curing tanks 13 are disposed between the centrifugal compactors 12 and are provided beneath the upper deck 2, as shown in FIG. 8.

Midway between the both edges of the upper deck 2 and the intermediate deck 3, there are held a pair of rails 15 extended from bow to stern. A ceiling traveling crane 16 is supported to run along these rails, over and across the two systems of component units. The crane is designed to carry the elongated molds 10 or the slender concrete products 17 taken out of the molds while orienting them in the fore-and-aft direction. The means of the crane 16 for suspending the molds 10 or the concrete products 17 in the specified direction may be any means commonly in use for that service.

Figure 6:
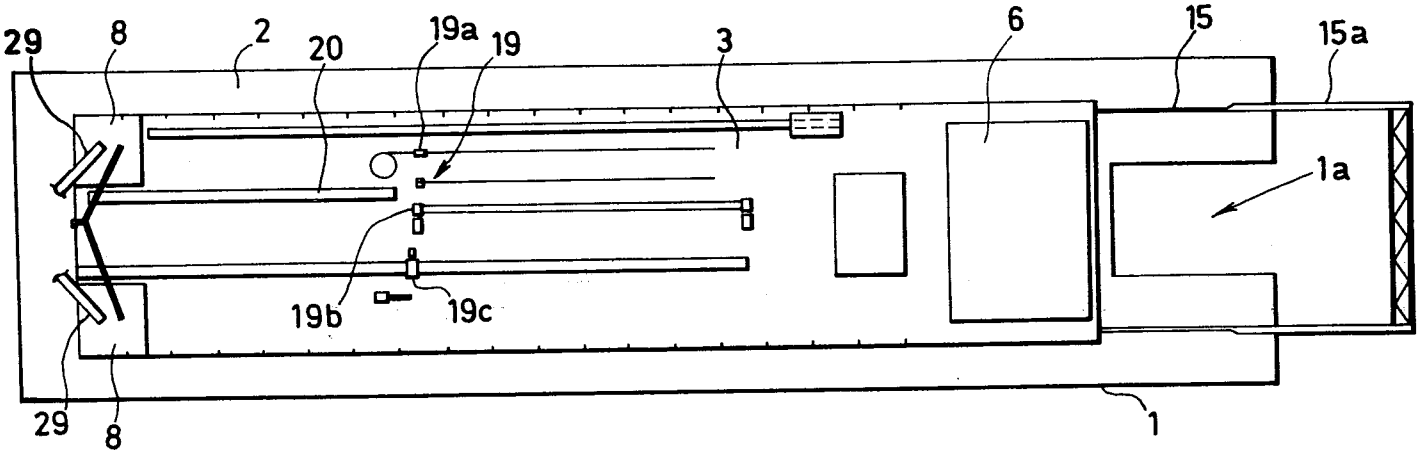
FIG. 6 is a plan view of the barge as seen from the intermediate deck above the upper deck.
Figure 2:
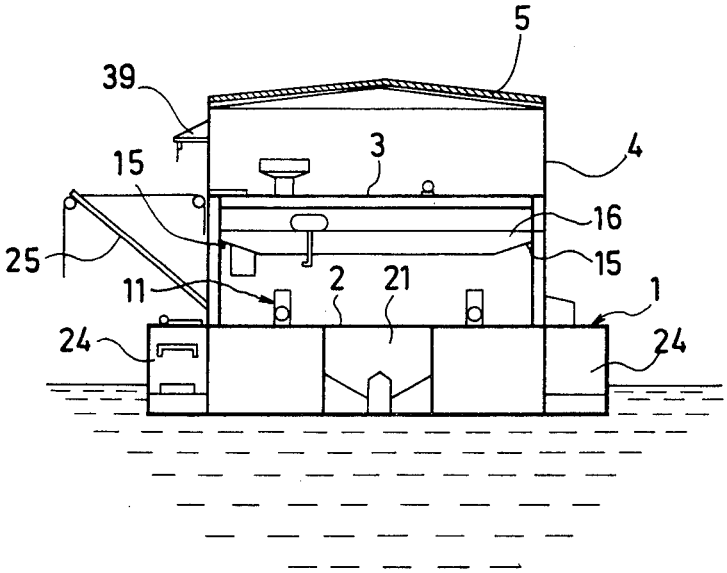
FIG. 2 is an enlarged cross sectional view taken along the line II—II of FIG. 1.
Figure 3:
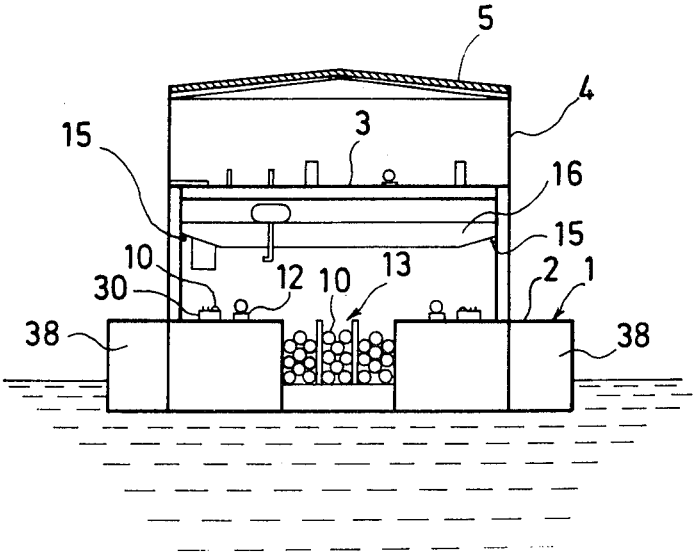
FIG. 3 is an enlarged cross sectional view taken along the line III—III of FIG. 1.
Figure 4:
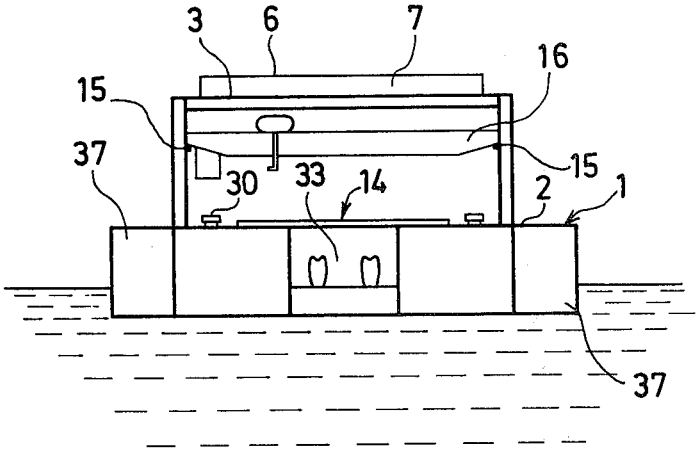
FIG. 4 is an enlarged cross sectional view taken along the line IV—IV of FIG. 1.
Figure 5:
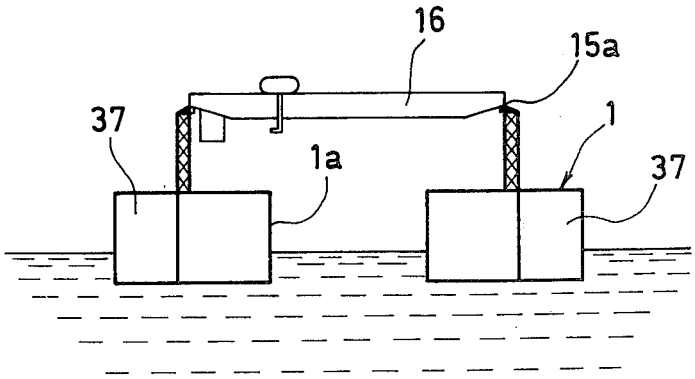
FIG. 5 is an enlarged cross sectional view taken along the line V—V of FIG. 1.
Figure 7:
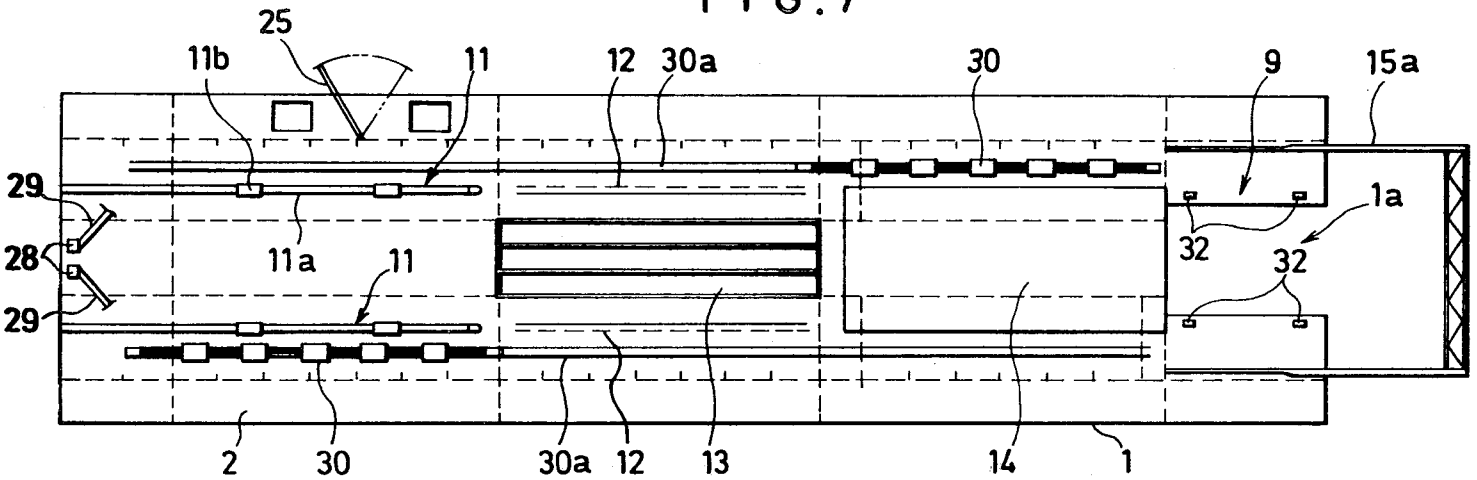
FIG. 7 is a plan view of the upper deck of the vessel.

In order that reinforcement cylinders 18 be introduced into the molds 10 disposed close to the concrete placers 11, a unit 19 for fabricating the cylinders is mounted on the intermediate deck 3 above the deck where the concrete placers are installed, as shown in FIG. 6. The unit 19 comprises a cutter 19*a* for bar steel or other reinforcement, a heading press 19*b*, and a netter 19*c*, all well known in the art of manufacturing reinforced concrete cylinders.

The reinforcement cylinders 18 thus fabricated are suspended and lowered through a narrow, elongated hatch 20 formed fore and aft in the intermediate deck 3 into the concrete placers 11 on the deck 2 below.

Figure 9:
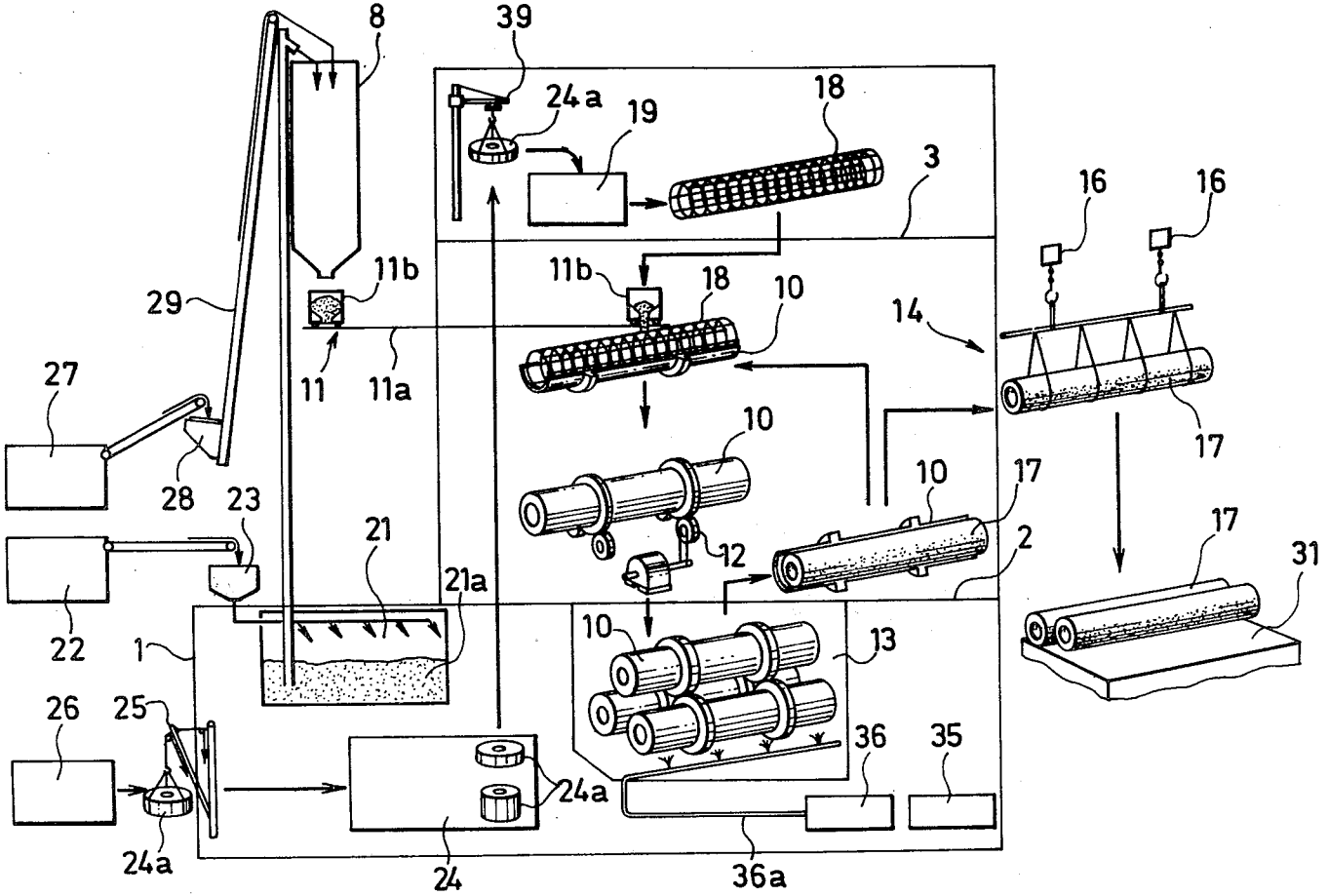
FIG. 9 is a flow diagram of the factory on board the vessel.

In the hull 1 is formed a cement hold 21 for storing the cement 21*a* to be fed to the batcher plant 8. As shown in FIG. 9, the hold 21 can store cement 21*a* with replenishment made from a shore cement supply tank 22 in an industrial district through a hopper 23 aboard the barge.

Also, the hull 1 includes reinforcement-storing holds 24 which can store reinforcement 24*a* supplied from an outside reinforcement supply base 26 in the industrial district by means of the vessel's own derrick 25.

In the vicinity of the batcher plant 8 on the hull 1, an aggregate hopper 28 is provided for receiving aggregates, such as sand and gravel, from a supply yard 27 in a consumption center for the reinforced concrete products. The aggregates supplied through the hopper 28, as illustrated in FIG. 9, are directly introduced into the batcher plant 8 by means of a conveyor 29.

Each mold 10, consisting of two mold members, is long enough to form a reinforced concrete product, such as a concrete pile or pole, and is supported fore and aft by a support base 11*a* of the associated concrete placer 11. Along each such support base 11*a*, concrete-placing trucks 11*b* are disposed so that they can run, guided by the rails on the upper deck 2. These trucks 11*b* are supplied with ready mixed concrete from the batcher plant 8 and place it into the molds 10.

Each mold filled with a predetermined amount of concrete is slung up fore and aft by the ceiling traveling crane 16 and is transferred, with the same orientation to the compactor 12, where the concrete is subjected to compaction.

The concrete inside having been compacted, the mold 10 is carried by the crane 16 into the curing unit 13, where the mold 10 is allowed to stand while maintaining the same orientation.

After curing of the concrete inside with steam in the curing unit 13, the mold 10 is moved by the crane 16, still with the same orientation, to the unit 14 for mold removal from the formed product.

Here the mold is parted into upper and lower halves, and the reinforced concrete product 17 taken out is carried by the crane 16 to the unloader 9. On the other hand, the disassembled mold 10 is brought back to the position alongside the concrete placer 11 by a mold-conveying train of trucks 30 which runs on rails 30*a* laid on the zone of the upper deck 2 closest to the vessel's side.

The unloader 9 for delivering reinforced concrete products comprises a U-shaped opening 1*a* formed at the fore end of the hull 1, extensions 15*a* of the rails 15 beyond the opening 1*a*, and means 32 for mooring a product delivery barge 31 within the U-shaped opening 1*a*.

In the machinery room 33 of the hull 1 are installed and engine 34, a generator 35, a boiler 36 and other auxiliaries. The steam generated by the boiler 36 is supplied through a steam line 36*a* to the steam-type concrete curing unit 13.

The hull 1 further includes ballast tanks 37, fresh water tanks 38, and a wall crane 39.

After the cement hold 21, reinforcement-storing holds 24, fresh water tanks 38, etc. have been filled up in a port of industrial district, the barge is self-propelled, towed, or pushed to a distant port or shore of the destination where the reinforced concrete goods manufactured aboard the vessel are required. Sands and other aggregates are procured locally.

As FIG. 9 indicates, the reinforcement 24*a* stored in each of the reinforcement-storing holds 24 is hoisted by the wall crane 39 up to the intermediate deck 3. In the reinforcement cylinder-fabricating unit 19 on that deck, where the reinforcement is cut by the cutter 19*a* to a predetermined length, headed by the heading press 19*b*, and netted to a cylindricl cage form by the netter 19*c* to provide a fabricated reinforcement cylinder 18 in accordance with standard practice in the manufacture of reinforced concrete cylinders.

The cylinder 18 thus formed is lowered through the hatch 20 onto the upper deck 2. It is fitted in the lower half of the mold 10, semicylindrical in cross section, and is transferred together to the concrete placer 11.

Meanwhile, in the batcher plant 8, the cement 21*a* from the cement hold 21 and the aggregates including sand directly supplied from the shore by means of the hopper 28 and the conveyor 29 are mixed with the water from the fresh water tanks 38 to prepare ready mixed concrete.

This concrete is placed into the lower half of each mold 10 by the trucks 11*b* of the concrete placer 11. The filled lower half is covered with the upper half of the same semicylindrical cross section, and the two halves of the mold 10 are clamped together by bolts, thereby to impart stresses to the reinforcement cylinder 18 inside.

Each mold 10 in which the concrete has been cast is transferred by the ceiling traveling crane 16 to the centrifugal compactor 12 for compaction of the concrete, and is thence transferred to the curing tank of the steam-type concrete curing unit 13.

The concrete in the mold 10 is cured until it attains desired strength, and then the mold is carried by the crane 16 to the mold remover 14, where the mold is disassembled and the reinforced concrete product 17 is taken out.

The reinforced concrete products 17 manufactured in the manner described are carried by the crane 16 to the unloading space 9, where they are transferred onto the delivery barge 31 and transported to the quay. Each mold 10 thus emptied is carried by the trucks 30 to the original position alongside the concrete placer 11.

The favorable effects and advantages the barge of the invention for the manufacture of reinforced concrete products offers may be summarized as follows:

(a) Constructing a factory on board a barge as under the invention is more time-saving and economical than building one ashore in the district where the goods are in demand.

(b) Built aboard the vessel, the floating factory has free access to distant consumption centers and is thereby capable of achieving a high rate of operation to economic advantage. (In oversea construction projects, the concrete factories or casting works set up for those purposes on land usually have to be taken away after the conclusion of the field work.)

(c) The freight or cost of transportation of the products is reduced.

(d) With minimum handling, the products have the least chance of being damaged, and such reinforced concrete products as piles can be directly and promptly delivered to the site of harbor work and to other field jobs.

(e) Since the reinforcement cylinder-fabricating unit is installed on the intermediate deck, the floor area of the upper deck below is reduced and hence the breadth and other dimensions of the vessel can be decreased. The objects to be handled by the unit are relatively light in weight (about three tons at most), and therefore mounting the unit on the deck above the upper deck poses no problem whatsoever for the hull strength of the vessel.

(f) The factory layout on the upper deck is such that the batcher plant, concrete placers, centrifugal concrete compactors, steam type concrete curing arrangements, mold remover, and product unloading arrangements are disposed from end to end of the vessel. This layout enables the products on the line to be delivered successively in the fore-and-aft direction, in a simple flow of production.

The mold carrier means for returning the molds, after their removal from the products, to their original position are arranged on the outermost sides (in the directions parallel and close to the both sides of the vessel), thus keeping the production flow pattern simple.

(g) The component units of equipment on the upper deck are arranged in two systems symmetrical with respect to the centerline of the hull. Consequently, good balance of loads relative to the centerline is established and lateral stability of the vessel is maintained.

(h) As compared with the dual system of equipment, the ceiling crane is of a sufficiently broad span to cover the equipment of both systems. The long-span crane abolishes the need of dead space which will otherwise be occupied by stanchions and the like amidships. Should either system fail, the crane will still serve the other system.

(i) In consideration of the availability of the individual materials, this factory barge is designed to obtain aggregates, such as sand and gravel, locally at the place of plant operation, and store cement, reinforcement and the like aboard and transport the latter from the industrial district to the destination. Because the vessel can be continuously supplied with the sand, gravel and other aggregates by a belt conveyor or the like from a stock yard on the shore or from a supply barge, the aggregate storage space may be omitted and accordingly the vessel is reduced in size. The cement and other supplies loaded at the distinct place of origin and stored within the vessel ensure stable production on board.

(j) The units of production equipment are arranged so that the products in process can be axially transferred in the fore-and-aft direction. Even when the product is long (say, 40 meters in length) and large (say, 1000 mm in diameter), the space requirement for its movement is limited. As a result, safe, desirable environments are provided for the personnel.

(k) Because the steam-type concrete curing unit is installed between the centerfugal compactors and below the upper deck, the depth of the hull can be fully utilized, with a corresponding reduction in the breadth of the vessel.

(l) Slender and elongated products of reinforced concrete, such as concrete piles, can be made economically in a stable operation.

What is claimed is:

1. A factory barge for manufacturing reinforced elongated concrete products comprising: a first deck, a second deck above at least part of said first deck; batcher plant means mounted at one end of the barge for preparing ready-mixed concrete; reinforced concrete product unloader means mounted at the opposite end of the barge; and, between said batcher plant means and said unloader means, in the following order: concrete molds, concrete placer means on said first deck for placing the concrete received from said batcher plant into said molds; compactor means for compacting the concrete in said molds; curing means for curing the compacted concrete in said molds; and mold removing means for removing said molds from the cured concrete products; means for transferring said molds from said placer means to subsequent units; and reinforcement fabricating means mounted on said second deck to introduce fabricated reinforcement members into said molds.

2. A factory barge according to claim 1, in which said batcher plant means for preparing ready-mixed concrete comprises a storage means for cement to be fed to said plant, and an aggregate hopper for receiving aggregates from the outside of the barge, and said barge further comprises storage means for reinforcement material to be fed to said reinforcement fabricating means.

3. A factory barge according to claim 1, in which said concrete products are elongated cylinders and said means for transferring said molds from said concrete placer means to said compactor means, said curing means and said mold removing means is so oriented with respect to the fore-and-aft direction of said barge as to handle said molds while maintaining the same in the fore-and-aft direction.

4. A factory barge according to claim 1, in which said reinforced concrete product unloader means comprises a U-shaped opening formed at said opposite end of said barge to accommodate a product delivery barge, and said barge comprises, in addition, means for transferring onto the delivery barge in said U-shaped opening, the elongated reinforced concrete products taken out of the molds by said mold removing means, said products being maintained longitudinally aligned in the afore-and-aft direction of said barge while being so transferred.

5. A factory barge according to claim 4, in which said means for transferring said molds and elongated reinforced concrete products, while maintaining them in the fore-and-aft direction comprises: rails laid along both sides of the hull; and a ceiling traveling crane traveling on said rails to reach said molds, said compactor means, and said unloader means.

6. A factory barge according to claim 1, in which said concrete placer means and said compactor means are arranged in two separate rows symmetrically on both sides of the centerline of the barge, said barge comprising, in addition: cement storage means and concrete curing means between said two separate rows and below said first deck.

7. A factory barge according to claim 1 comprising, in addition: rails located on the outermost sides of said first deck and extending along both sides of said barge; and mold trucks running along said rails to bring the molds released by said mold remover back to the original position alongside said concrete placer means.

* * * * *